US005163511A

United States Patent [19]

Amundson et al.

[11] Patent Number: 5,163,511

[45] Date of Patent: Nov. 17, 1992

[54] METHOD AND APPARATUS FOR IGNITION OF DOWNHOLE GAS GENERATOR

[75] Inventors: Robert Amundson, Portage, Ind.; Charles H. Ware, Charleston, W. Va.; Glenn B. Topping, Park Forest, Ill.

[73] Assignee: World Energy Systems Inc., Fort Worth, Tex.

[21] Appl. No.: 785,306

[22] Filed: Oct. 30, 1991

[51] Int. Cl.[5] ..... E21B 43/24

[52] U.S. Cl. ..... 166/303; 166/59; 431/163

[58] Field of Search ..... 166/59, 63, 302, 303; 431/163

[56] References Cited

U.S. PATENT DOCUMENTS

| | | | |
|---|---|---|---|
| 3,712,375 | 1/1973 | Berry et al. | 166/251 |
| 3,982,591 | 9/1976 | Hamrick et al. | 166/302 |
| 3,982,592 | 9/1976 | Hamrick et al. | 166/302 |
| 4,050,515 | 9/1977 | Hamrick et al. | 166/303 |
| 4,053,015 | 10/1977 | Hamrick et al. | 166/302 |
| 4,077,469 | 3/1978 | Hamrick et al. | 166/59 |
| 4,078,613 | 3/1978 | Hamrick et al. | 166/302 |
| 4,159,743 | 7/1979 | Rose et al. | 166/302 |
| 4,199,024 | 4/1980 | Rose et al. | 166/59 |
| 4,336,839 | 6/1982 | Wagner et al. | 166/59 |
| 4,397,356 | 8/1983 | Retallick | 166/303 |
| 4,445,570 | 5/1984 | Retallick | 166/59 |
| 4,456,068 | 6/1984 | Burrill, Jr. et al. | 166/303 |
| 4,463,803 | 8/1984 | Wyatt | 166/59 |

*Primary Examiner*—Ramon S. Britts
*Assistant Examiner*—Frank S. Tsay
*Attorney, Agent, or Firm*—Arthur F. Zobal; Geoffrey A. Mantooth

[57] ABSTRACT

A downhole gas generator can be ignited downhole by an ignitor mixture combining with an oxidant. The ignitor mixture is provided by an ignitor subsystem. In one embodiment, the ignitor subsystem bubbles gaseous fuel through a chamber of liquid pyrophoric. The chamber is heated, wherein the fuel obtains a vapor content of the pyrophoric, forming a gaseous ignitor mixture. In another embodiment, gaseous fuel is turbulently injected into a chamber. Liquid pyrophoric enters the chamber through an orifice. The fuel passes through a nozzle wherein its pressure is reduced. This pressure drop is imposed on the pyrophoric, wherein the pyrophoric is drawn into the chamber. The fuel mixes with and atomizes the pyrophoric to form an ignitor mixture.

21 Claims, 5 Drawing Sheets

METHOD AND APPARATUS FOR IGNITION OF DOWNHOLE GAS GENERATOR

FIELD OF THE INVENTION

This invention is directed to a method and apparatus for achieving ignition of downhole gas generators which are used for thermal or chemical treatment of underground petroleum reservoirs.

BACKGROUND OF THE INVENTION

Enhanced recovery methods are used to extract viscous crude oil from petroleum reservoirs located below the ground. Typically, when a reservoir is tapped by boreholes, only a small portion of the oil can be extracted using conventional methods. These methods include utilizing the natural pressures of the reservoirs to bring the oil to the surface and pumping the oil out of the reservoirs lacking such natural pressures.

Enhanced recovery methods reduce the viscosity of the crude oil in the reservoir, allowing it to be transported to the surface up through the boreholes. One such enhanced recovery technique utilizes heat and hot gases, which are used to liquify the oil in the reservoir. The heat and hot gases are generated by combustion systems located either on the surface or inside of a borehole.

Considerable attention has been given in the last decade or so to the development of combustion systems inserted into wellbores to achieve the generation of heat and hot gases near a petroleum reservoir face. Combustion located near the intended delivery point reduces the problems of wellbore heat loss and casing expansion which would be encountered with surface combustion followed by hot fluid delivery through tubing strings. In addition, better heat economy is achieved due to the reduced heat loss to adjacent non-producing bedrock.

The design of downhole gas generators involves many constraints which would not be encountered in surface combustion. Combustor diameter and length must be kept to a minimum. The financial incentive to use standard well casings of from $7\frac{5}{8}$ inches to $10\frac{5}{8}$ inches leads to torpedo-shaped combustor configurations which utilize length more than cross-section to achieve the required combustion volume. Field operating experience indicates that the total length of the equipment required for packing, combustion, and coolant addition must be within the range of 5 to 20 feet. Representative heat delivery requirements range from 10 to 75 million Btu/hr, which means that high-performance combustor design is required to achieve a very high density of heat release using turbulent combustion. Due to the resulting high velocity of injectants, some type of flame holder is required to prevent flameout after ignition is completed. The equipment must be easily insertable into a well of 2000 feet or more depth. This requirement dictates that the numbers of supply tubes, control tubes, and sensor and control wires be kept to an absolute minimum.

The equipment must be capable of reliable operation for a period of one year or more without removal for servicing. During this period a multiplicity of ignitions and shutdowns must be accommodated, and re-ignition may have to be performed in the presence of exiting wellbore pressures as high as 2000 psia. It is the problem of ignition of a downhole gas generator, without removing the generator from the borehole, to which the present invention is directed.

In Hamrick, et al., U.S. Pat. No. 3,982,591, there is described a downhole gas generator burning hydrogen and oxygen in a one-stage cylindrical combustor. One embodiment discloses an electrical ignition means using a glow plug or spark plug which is activated by a downhole ignition transformer which is in turn powered by wires from the surface. Although this approach would be operable, it has the disadvantage of requiring additional wires in the wellbore. Furthermore, the severe environment which could include high temperatures, volatilized hydrocarbons, steam, and salts near the combustor would accelerate deterioration of these downhole wires through degradation of or leakage through insulation. The current art of wellbore cables is such that a service life of over one year would be unlikely, severely degrading the reliability of such an ignition system.

Another embodiment of U.S. Pat. No. 3,982,591 discloses an electrical ignition means using a glow plug or spark plug which is activated by a downhole battery. An electrical contact is coupled to a downhole valve to connect the battery for ignition, and a heat switch is coupled to the generator wall to detect successful ignition and turn off the ignitor. Since the downhole valve is already required to control the injection of combusting and cooling fluids, this ignition approach answers the concern to minimize the number of downhole wires. However, it has the disadvantage of requiring a heat switch to be located as close to the flame as possible to minimize response time. Such a heat switch would be a mechanical device with a relatively low expected mean-time-to-failure. Also, the reliance on mechanical contacts could eventually produce intermittent operation leading to a catastrophic detonation when unburned injectants accumulate. This approach has a further disadvantage in requiring a non-rechargeable battery having sufficiently high energy to perform many ignitions as well as having a long shelf life in the severe environment previously mentioned. The current art of batteries is such that a service life of over one year would be unlikely.

In Wyatt, U.S. Pat. No. 4,463,803, there is described a downhole gas generator burning fuel and air in a one-stage cylindrical combustor. A spark plug and downhole ignition transformer are employed as ignition means. Wyatt provides an improvement over prior art by enclosing the transformer and borehole wiring in a metal casing to protect them from the severe environment. Nevertheless, this approach still requires an additional wellbore conduit to support the ignition means. The extra conduit could be eliminated by running the wires inside a supply tube and using high-pressure wire feedthroughs (such as are manufactured by Conax Corporation, Buffalo, N.Y.) to convey the wires out of the tube at both ends. However, this assembly would be very difficult to make and service in the field.

A further drawback of the glow plug or spark plug is their short lifetime in this highly reactive combustion environment. Sandia National Laboratories was not able to achieve more than a four-week lifetime for glow plugs in either an air-diesel or oxygen-diesel burner.

An ignition means based on autocatalytic ignition of a flowing fuel and oxygen stream through a noble metal catalyst bed would have the advantage of utilizing the same supply tubes as are used to sustain combustion. The U.S. space program has had success in using such a catalyst to ignite hydrogen and oxygen in rocket steering motors. In Berry, et al., U.S. Pat. No. 3,712,375, there is described an open tube combustor for heat generation which is ignited and sustained by a catalyst. Berry teaches that the fuel must contain at least 10% by volume of hydrogen or be preceded by a slug of hydrogen to avoid the need to preheat it. In the presence of a platinum catalyst, hydrogen will react with air at temperatures as low as 20 degrees F. and with oxygen at even lower temperatures. All other fuels surveyed required injectant preheating to at least 200 degrees F. Although other fuels could be used to sustain combustion after being initiated by a slug of hydrogen, reliability would be enhanced only if the catalytic action is sustained to serve as a fail-safe flame holder. Furthermore, additional valving would be required to divert other fuels around the catalyst. Therefore this ignition means can only be effectively applied to gas generators utilizing hydrogen fuel. Other means must be sought for generators using cheaper alternative fuels which are more suited to some steam delivery applications.

An ignition means based on bringing together a hypergolic fuel and oxidant combination has appeal because methods can be devised to use the combustor's fuel and oxidant supply tubes and to ignite any fuel-oxidant combination desired. Several liquid and gaseous pyrophoric compounds have been widely applied in the art since 1960 for initiation of in situ combustion by autoignition with air in an open fashion at the bottom of a well. Due to their inherent simplicity of use, pyrophorics and other hypergolic combinations have been considered as ignition means for downhole gas generators as well. The earliest reference is Hamrick, et al., U.S. Pat. No. 4,050,515, which mentions the use of a hypergolic combination of fuel and oxidizer to effect ignition of a downhole hydrogen-oxygen combustor, but does not define a process.

Hamrick, et al., U.S. Pat. No. 4,053,015, further defines various hypergolic combinations, an ignition sequence, and associated hardware to perform this sequence. In the described process, a slug of hypergolic fuel is introduced into the generator fuel supply line and allowed to descend by gravity and pool behind the downhole valve while it is closed. A slug of oxidizer or gaseous oxidant pressure is likewise introduced into the generator oxidant supply line. Normal generator fuel and oxidant pressures are established behind the slugs, and the downhole valves are opened to start ignition. Although Hamrick and Rose claim any process wherein the starter fuel is different from the generator fuel, they teach that the starter fuel is preferably a liquid. This recommendation follows from the reliance upon gravity to properly position the starter compounds so that their flows can start simultaneously. In the preferred embodiment, a number of hypergolic combinations are listed, and the fuel component in each of these is liquid at bedrock temperatures (except lithium borohydride, which would have to be diluted by a solvent since it is a solid). Of the listed choices, triethylborane (TEB) or triethylaluminum (TEA) together with air or oxygen are the best combinations. Some of the other choices generate highly corrosive byproducts, and some represent severe safety problems regarding toxicity or explosive instability.

Liquid TEB has been described in prior art as an ignition means for downhole gas generators which burn liquid fuels (for example, diesel and crude oil). In Wagner, et al., U.S. Pat. No. 4,336,839, there is described a downhole generator utilizing a liquid fuel atomizer feeding into a small air mixing chamber followed by a larger combustion chamber. The preferred embodiment uses a hypergolic slug such as TEA/TEB conveyed by a separate supply line. A "U" tube is described as feeding into a downhole storage tank for the pyrophoric, but design details and a sequence of operation are not described or illustrated. In Retallick, U.S. Pat. No. 4,397,356, there is described a catalytically-enhanced generator. A hypergolic fuel preceding the gaseous or liquid hydrocarbon fuel is mentioned as a possible ignition means. Similarly, Retallick, U.S. Pat. No. 4,445,570, mentions but does not detail the use of a hypergolic fuel.

Several downhole gas generators have been successfully designed and tested which burn liquid fuels with air and which utilize liquid TEB for ignition. Sandia National Laboratories achieved reliable ignition of both air-diesel and oxygen-diesel burners by inserting a slug of TEB ahead of the normal fuel and thus utilizing one supply line and atomizer means for both ignition and combustion phases. The generator detailed by Burrill, Jr. et al., U.S. Pat. No. 4,456,068, and tested by Sandia utilized the same ignition means.

Our experience has shown that problems arise when a liquid pyrophoric slug is used in a downhole generator which burns a gaseous fuel. We designed and built a hydrogen-oxygen burner which included a multiplicity of separate stages in order to achieve a large turndown range as described in Rose, et al., U.S. Pat. No. 4,199,024. A pilot stage was employed as a low-velocity mixing chamber for pyrophoric ignition followed by fuel-rich hydrogen-oxygen combustion at a moderate temperature to serve as a flame holder for succeeding stages. To minimize the number of conduits, a liquid TEB slug was used in the hydrogen line as taught by Hamrick and Rose and described previously. Tests with a volume of from 0.5 to 3.0 cubic inches of TEB led to rapid destruction of the pilot exit nozzle and the oxygen injector.

This was because of the vast difference in flow characteristics between the liquid slug and gaseous hydrogen. The orifices of the fuel and oxygen injectors had been sized to project the hydrogen-oxygen flame toward the center of the pilot chamber while holding injector pressure drops within workable limits. A nozzle which operated in critical flow with a nominal 1500 psig supply had been installed directly upstream of each downhole valve to set flow independently of chamber pressure, and the downhole valve in turn fed through a 12-inch long tube to the pilot injector. When the fuel and oxygen valves were opened, the liquid slug was forced through the injector at a velocity of 500 ft/sec. The time to inject a 0.5 cubic inch slug was a very short 27 milliseconds, whereas the time to flow enough oxygen to consume it was 8.5 seconds. Consequently, the TEB was splattered onto the chamber wall and other components due to the high velocity and lack of oxygen. Then the incoming oxygen reacted with these splatters at nearly the adiabatic flame temperature (estimated to be 5500 degrees F.) and started a steel fire. If the flow control nozzle and downhole valve were interchanged so that the liquid flow would be metered, then an unacceptably long delay of 21 seconds would ensue while the fuel tube filled behind the injector. In conclusion, the design parameters for a good hydrogen injector do not make a good liquid injector.

The ideal solution to this problem is to insert a volume of a gaseous pyrophoric compound ahead of the hydrogen so that the ignitor flow characteristics more nearly match those of the fuel. We rejected phosphine ($PH_3$) due to its extreme toxicity. Tests with silane ($SiH_4$), either pure or mixed with hydrogen, have shown that it is not pyrophoric at ambient temperature if the pressure is above 230 psia. Trimethylborane (TMB) was rejected since relatively little is known about it and it is only produced in small quantities by special order. The solution to our problem was the use of TEB in a vaporized state and diluted with hydrogen.

SUMMARY OF THE INVENTION

It is an object of the present invention to provide a reliable ignition means for downhole gas generators which burn gaseous fuels with air or oxygen over a wide range of downhole pressures which utilize turbulent combustion to deliver heat outputs of from 10 to 75 million Btu/hr.

Another object of the present invention is to provide a controlled process of pyrophoric ignition wherein the pyrophoric component is mixed with and diluted by normal generator fuel so that a fuel-rich state and a moderate temperature result during the ignition transient.

Still a further object of the present invention is to provide an ignition process and apparatus which can be used to initiate combustion in a pilot stage which is isolated from the main generator stage and discharges hot gas which in turn is used to propagate downstream combustion in a reliable manner.

Yet a further object of the present invention is to provide an ignition process and apparatus which lead to the simplest possible downhole system by minimizing the number of supply tubes, control tubes, and sensor and control wires.

Accordingly, the present invention provides a process and associated apparatus for performing ignition of downhole gas generators which burn gaseous fuels such as hydrogen or natural gas. Ignition is performed by mixing an ignitor mixture with an oxidant in the downhole generator. The ignitor mixture is made from gaseous fuel and liquid pyrophoric, wherein the liquid pyrophoric has been either vaporized into the fuel or atomized and mixed into the fuel. The ignitor mixture is thus treated as a gas.

One process of producing the ignitor mixture relies upon the vapor pressure of a pyrophoric at elevated temperatures to vaporize and mix it with the gaseous fuel. The apparatus for this process comprises a vaporizer containing pyrophoric liquid through which fuel is bubbled, a nozzle to control the ignition mixture flow, and a downhole valve to connect the ignitor to the generator. Separate supply lines and downhole valves can be used for said pyrophoric and the normal generator fuel, or the hardware can be simplified by producing the ignitor at the surface and inserting it as a gaseous slug.

Another process relies upon atomization and entrainment of liquid pyrophoric droplets to be carried with the flow of said gaseous fuel. The apparatus for this process comprises an atomizer through which both pyrophoric liquid and fuel pass, a nozzle to control the ignition mixture flow, and a downhole valve to connect the ignitor to the generator. Similarly, the hardware can be simplified by producing the ignitor at the surface and inserting it as a slug. For either process a separate pilot stage and fuel injector may be utilized to ensure fail-safe flame propagation of succeeding stages, or ignition may be performed in a single-stage combustor.

One important aspect of the present invention is the ease of controllability of the ignitor mixture. Because the ignitor mixture is gaseous, it can be controlled downhole using nozzle assemblies and lime pressures. Thus, safe and reliable downhole ignitions can be produced again and again.

Another important aspect of the present invention is the inherent relative safety of the ignitor mixture. Because the ignitor mixture is primarily fuel, with only small, controlled amounts of pyrophoric added thereto, the ignition transient downhole in the combustion chamber is moderated. The pyrophoric is diluted with the fuel and is thus unable to start a steel fire downhole.

DESCRIPTION OF PREFERRED EMBODIMENTS

Figure 1:
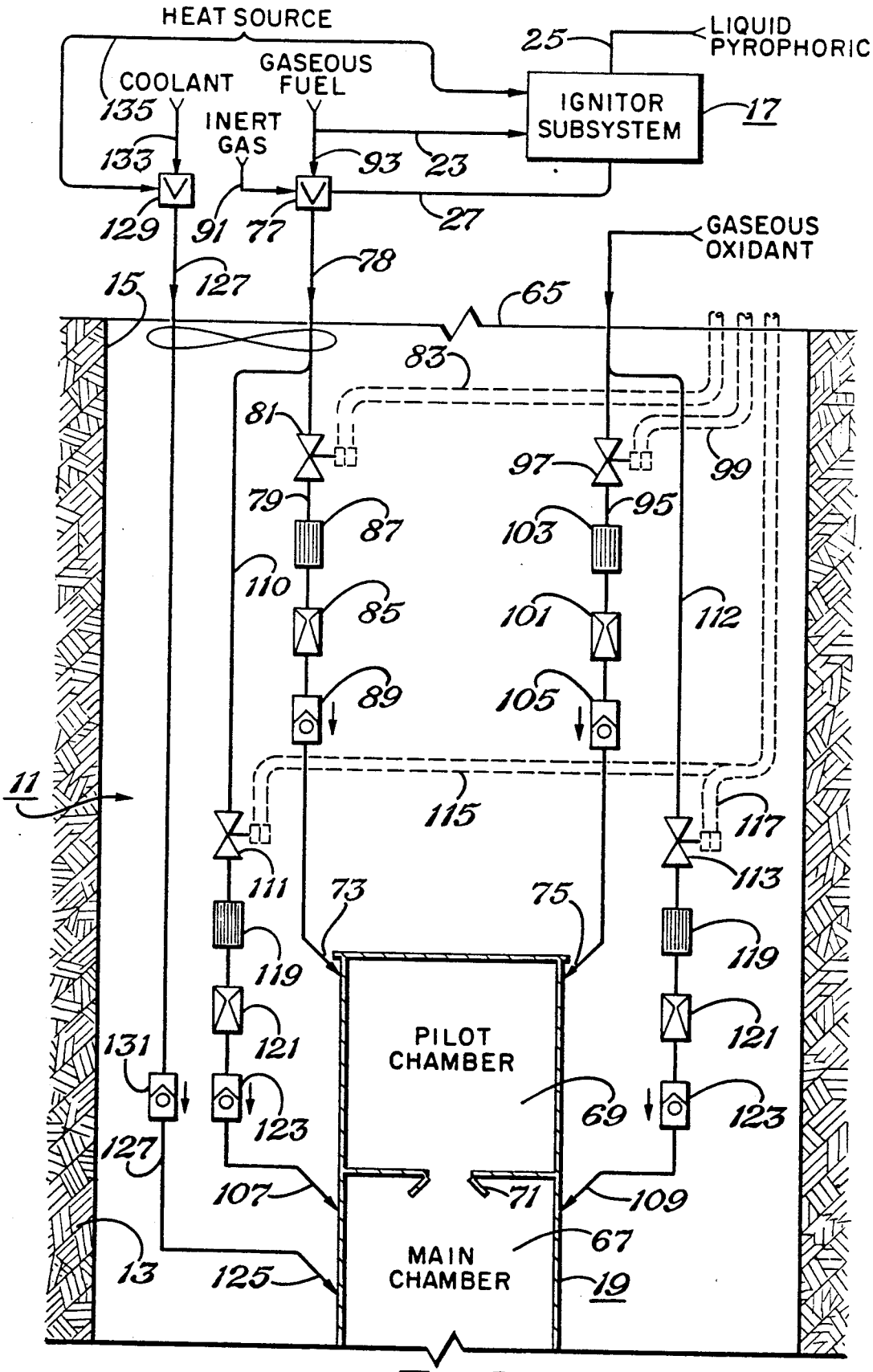
FIG. 1 is a schematic diagram of a downhole gas generator, complete with an ignitor subsystem, of the present invention, in accordance with a preferred embodiment, which ignitor subsystem is on the surface.

In FIG. 1, there is shown a schematic diagram of a downhole gas generator system 11 of the present invention, in accordance with a preferred embodiment. The gas generator system 11 provides heat and hot gases to an oil-bearing formation 13 that is penetrated by a borehole 15, which heat reduces the viscosity of heavy crude oil, thereby enabling its recovery. The heated crude oil is typically recovered by other boreholes located nearby the gas generator borehole. All of the boreholes penetrate the same petroleum reservoir.

The gas generator system 11 includes two subsystems, an ignitor subsystem 17 and a combustor or generator subsystem 19. The generator 19 is located in the borehole and is used to produce hot gases and heat for transmission to the oil-bearing formation. The generator 19 uses gaseous fuel and a gaseous oxidant, which combust in a combustion chamber. Examples of fuel that could be used include natural gas or hydrogen. Examples of oxidants that could be used include air, oxygen or enriched air (air that has been enriched with oxygen). Ignition of combustion in the generator 19 is achieved by using an ignitor mixture produced by the ignition subsystem 17. Ignition is achieved downhole, so that the generator does not have to brought up to the surface to be ignited, a timely and costly procedure.

Figure 3:
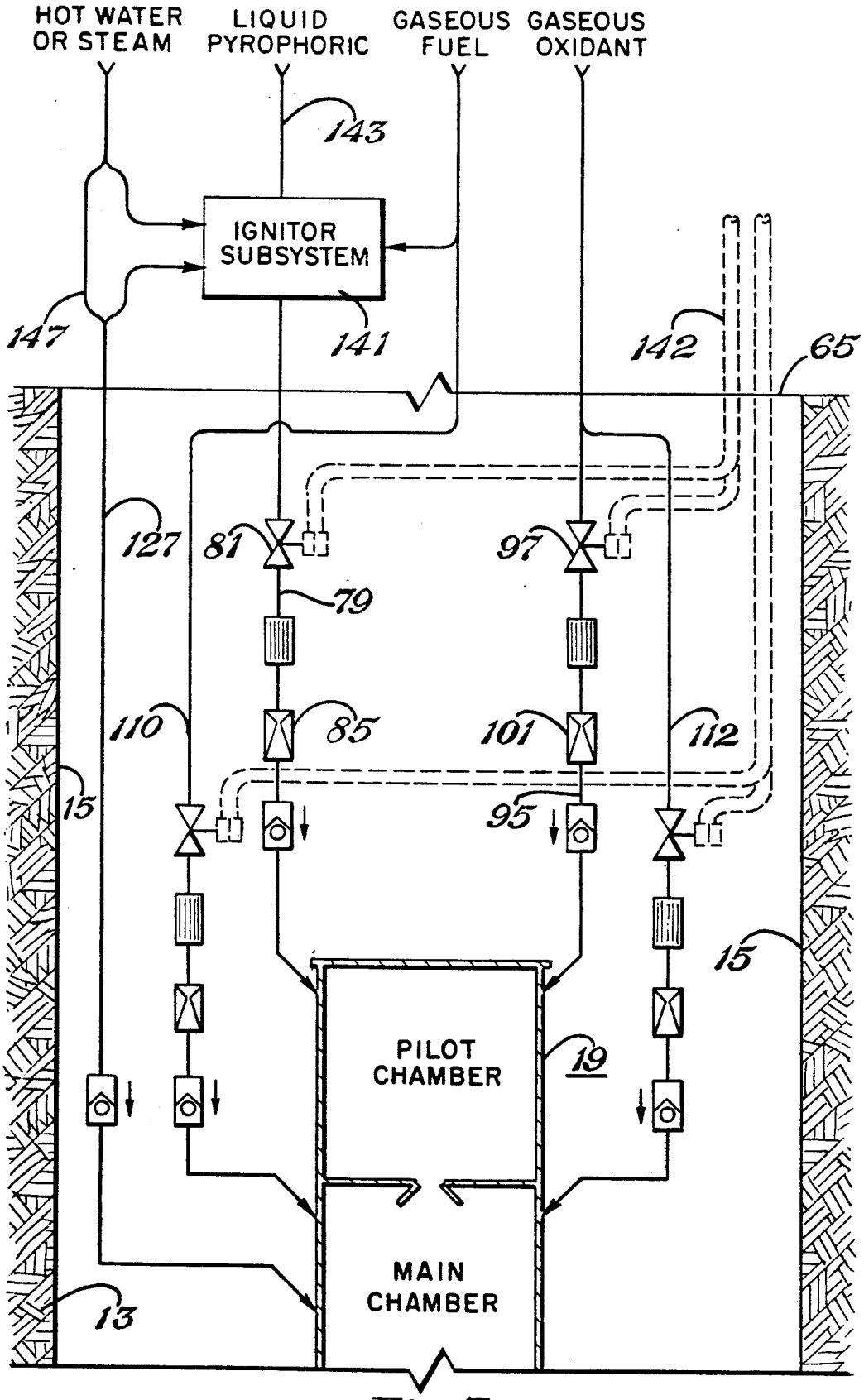
FIG. 3 is a schematic diagram of a downhole gas generator with a downhole ignitor subsystem, in accordance with another embodiment of the invention.

The ignition subsystem 17 can be located on the surface, as shown in FIG. 1, or downhole with the combustor subsystem, as shown in FIG. 3.

Figure 2:
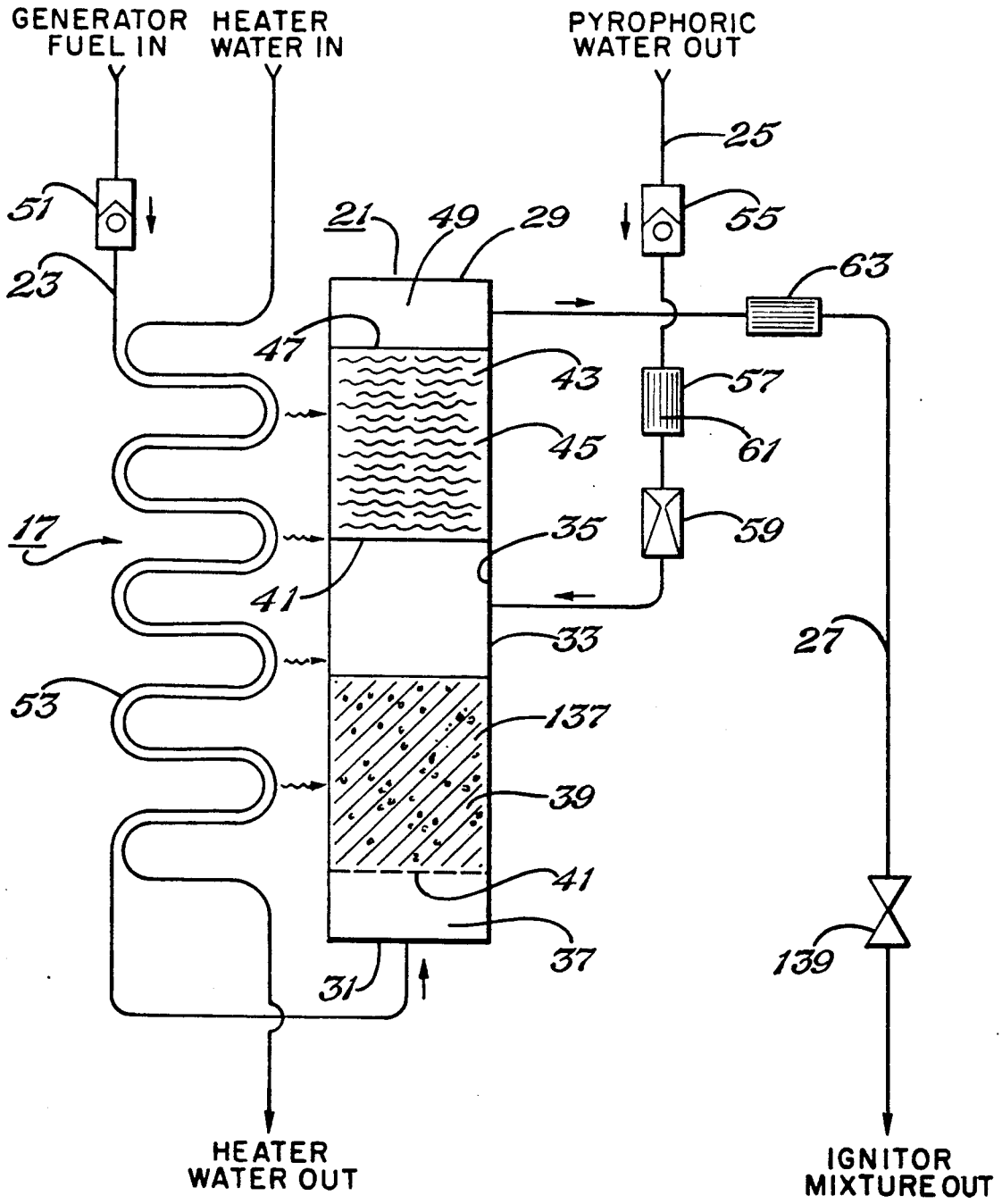
FIG. 2 is a schematic diagram of a vaporizer ignitor subsystem of the present invention, in accordance with a preferred embodiment.

Referring to FIG. 2, the ignition subsystem 17 provides a gaseous ignitor mixture to the combustor. The ignitor subsystem 17 mixes a gaseous fuel with a liquid pyrophoric by vaporizing the liquid pyrophoric into the gaseous fuel. In the preferred embodiment, the pyrophoric is TEB (triethylborane). The ignitor subsystem 17 includes a vaporization chamber unit 21, a fuel inlet line 23, a pyrophoric inlet line 25 and an ignitor outlet line 27.

The vaporization chamber unit 21 has top, bottom and side walls 29, 31, 33 enclosing a chamber 35 therein. The chamber 35 is elongated between the top and bottom walls 29, 31 and is oriented in a generally vertical manner so that the top wall is above the bottom wall.

The vaporization chamber unit 21 has plural zones therein. At the bottom of the chamber is a gaseous fuel inlet zone 37. The fuel inlet line 23 enters the chamber 35 at or near the bottom wall 31 so as to provide fuel to the gaseous fuel inlet zone 37. Just above the gaseous fuel inlet zone 37 is a heating and vaporization zone 39 for holding a reservoir of liquid pyrophoric. A sparger plate 41 is interposed between the gaseous fuel inlet zone 37 and the heating and vaporization zone. Located above the heating and vaporization zone 39 is a screening zone 43 for screening out droplets of liquid. The screening zone 43 contains a packed stainless steel mesh 45 located between upper and lower screen plates 47. The pyrophoric inlet line 25 enters the chamber 35 through the side wall 33 at a location that is between the heating and vaporization zone 39 and the screening zone 43. Above the screening zone 43 is a space 49 for tapping off the ignitor mixture in the chamber 35. The ignitor outlet line 27 exits the chamber 35 from the space 49.

The fuel inlet line 23 is connected to a generator fuel supply (not shown). A one-way check valve 51 is provided in the fuel inlet line 23 to prevent the contents of the vaporization chamber unit 21 from backing up. The fuel inlet line 23 passes through a heat exchanger 53 for preheating the generator fuel. In the preferred embodiment, the heat exchanger 53 is made up of coil tubing through which a hot fluid flows. Alternatively, the heat exchanger 53 may be made up of electrical heating tape. The fuel line 23 is coiled adjacent to the heat exchanger tubing 53. The heat exchanger is used to heat the chamber 35 as well as the fuel line 23. The heat exchanger tubing 53 is coiled around the vaporizer chamber unit 21 for heating the chamber.

The pyrophoric inlet line 25 is connected to a liquid pyrophoric supply (not shown). Both the pyrophoric supply and the generator fuel supply are located on the surface of the ground, near the borehole entry site. The pyrophoric inlet line 25 has a one-way check valve 55, a filter 57 and a metering nozzle 59. The filter 57 has a filter element 61 that is preferably made of sintered stainless steel and that has a mean pure diameter which is sized to trap any solid particles that would clog the small opening in the nozzle 59. The nozzle 59 is a square-edged type or venturi orifice type.

The ignitor outlet line 27 has an inline filter 63 that traps solid particles that may break loose from the screening mesh 45.

The ignitor subsystem 17 may be located on the surface or in a borehole and is connected with the generator 19. Referring to FIG. 1, the ignitor subsystem 17 is located on the surface 65.

The generator 19 is cylindrical and has a main chamber 67, which receives a majority of the reactants and coolant, and a pilot chamber 69, which serves as a flame holder. The pilot chamber 69 provides a low-velocity retention site for the ignitor and the oxidant. The pilot chamber 69 communicates with the main chamber 67 via a pilot exit nozzle 71.

The pilot chamber 69 is provided with an ignitor/fuel injector 73 and an oxidant injector 75. The ignitor/fuel injector 73 is connected to an outlet line 78 of a three-way valve 77 by way of an ignitor/fuel line 79. The ignitor/fuel line 79 has a downhole pilot fuel valve 81 and a nozzle assembly. The pilot fuel valve 81 is remotely controllable from the surface by a pair of wires 83. The nozzle assembly includes a nozzle 85, a filter 87 to prevent clogging of the nozzle and a one-way check valve 89 to prevent backflow. The nozzle 85 is preferably of the venturi-type so that downstream pressures can approach supply pressures without affecting flows. The three-way valve 77 has an inert gas supply input 91, a gaseous fuel supply input 93 and the ignitor outlet line 27. The oxidant injector 75 is connected to a gaseous oxidant supply on the surface by way of an oxidant line 95. The oxidant line 95 has a downhole pilot oxidant valve 97 and a nozzle assembly. The pilot oxidant valve 97 is remotely controllable from the surface by a pair of wires 99. The nozzle assembly includes a venturi-type nozzle 101, a filter 103 and a one-way check valve 105.

The main chamber 69 is provided with a fuel injector 107 and an oxidant injector 109. The fuel injector 107 is connected to the outlet line 78 of the three-way valve 77 by way of a fuel line 110. The fuel line 110 has a downhole main fuel valve 111 and nozzle assembly. The oxidant injector 109 is connected to the oxidant supply by way of an oxidant line 112. The oxidant line 112 has a downhole main oxidant valve 113 and nozzle assembly. Both valves 111, 113 are remotely controllable from the surface by respective wires 115, 117 and both nozzle assemblies include a filter 119, a venturi-type nozzle 121 and a one-way check valve 123. The main chamber 69 also has an inlet 125 for introducing coolant into the chamber. A coolant line 127 extends from a surface valve 129 to the coolant inlet 125. A one-way check valve 131 is provided in the coolant line 127. The surface valve 129 has two inputs 133, 135, one of which is connected to a surface supply of coolant and the other of which is connected to a source of heated water. The surface valve 129 allows the heated water and the coolant to mix, thereby preheating the coolant before its introduction into the main chamber. The heated water also serves to provide heat to the ignitor subsystem in the heat exchanger 53. The coolant line 127 and the fuel line 78 are located adjacent to each other for some distance down the borehole in order to preheat the fuel.

The operation of the gas generator system 11 will now be described. The generator 19, which is located downhole, is ignited by mixing an ignitor mixture from the ignitor/fuel injector 73 and an oxidant from the oxidant injector 75 in the pilot chamber 69. The ignited pilot chamber ignites the fuel and oxidant in the main chamber 67. The combustion in the main chamber produces the hot gases that are used in the enhanced recovery process.

To ignite the pilot chamber 69, the ignitor subsystem 17 is utilized. The ignitor subsystem utilizes a liquid pyrophoric, which is vaporized into the gaseous fuel by the use of heat and mixing. The ignitor mixture that is produced by the ignitor subsystem is introduced into the pilot chamber 69 through the ignitor/fuel injector 73.

The production of the ignitor mixture will now be described, referring to FIG. 2. Before the introduction of the pyrophoric into the vaporization chamber 35 of the vaporization chamber unit 21, the unit is depressurized to either the downhole pressure, if located downhole, or to atmospheric pressure if located on the surface. The chamber 35 is purged of residual oxygen by displacement with nitrogen or generator fuel introduced through the fuel inlet line 23.

After purging, the pyrophoric liquid 137 is introduced into the chamber 35 through line 25. A known amount of pyrophoric liquid can be delivered to the chamber 35 by controlling the pressure on the inlet line 25 and by knowing the pressure in the ignitor outlet line 27.

After filling the chamber 35 with a metered amount of pyrophoric liquid 137, the chamber 35 is pressurized with generator fuel and heated to the desired operating temperature. The normal generator fuel is slowly added to the chamber by way of the fuel inlet line 23, while the ignitor outlet line 27 is closed by a valve 139. The valve 139 is remotely controllable by wires (not shown). A gas pressure inside of the chamber 35 is established, which pressure is sufficient so that the desired delivery pressure to the generator will be obtained after the gas heats up. Heat is then applied to the unit 21 by the heat exchanger 53. The check valve 51 prevents the backward migration of pyrophoric into the fuel line 23.

When the downstream valve 139 is opened to utilize the ignitor mixture, the gaseous generator fuel enters the heated and pressurized chamber 35. The incoming fuel is preheated by the heat exchanger 53. The fuel flows through the holes in the sparger plate 41, which generates small bubbles in the liquid 137. The gas bubbles of fuel pick up a vapor content of pyrophoric which is equal to the liquid's pressure at the liquid's temperature. The resulting gaseous mixture has a vapor content which is dependent only on temperature and which is thus very predictable. The screen 45 traps any liquid droplets of pyrophoric which may have become entrained by bubbles bursting at the liquid surface. The droplets either drip back down into the vaporization zone 39 or later become vaporized. The fuel/pyrophoric ignitor mixture exits the chamber 35 and flows into the outlet line 27, where it may be used to ignite the generator 19. The filter 63 traps solid particles that may break loose from the screen 45.

The start-up of the generator 19 will now be described, referring to FIG. 1. The downhole valves 81, 97, 111, 113 are all closed. The desired oxidant pressure is established in the oxidant line 95. An inert gas such as nitrogen or helium is used to fill the fuel line 78 through the three-way valve 77 until the desired starting pressure is established. Then, the valve 77 is switched to the output of the ignitor subsystem 17. The downhole pilot fuel valve 81 is opened and a flow interval is allowed which is sufficient for all of the inert gas to flow into the pilot chamber 69. The flow interval time can be approximated by knowing the gas' temperature and pressure, the calibration of the flow control assembly 85, 87, 89 and the downhole line volume. Sufficient lead is allowed so that the ignitor mixture which has been entering the line behind the inert gas slug proceeds to flow through the injector 73 into the pilot chamber. Then, the downhole pilot oxidant valve 97 is opened and oxidant proceeds to flow through injector 75 into the pilot chamber 69. The oxidant reacts with the ignitor mixture in the pilot chamber producing combustion. By slightly leading the ignitor mixture into the pilot chamber 69 before introducing the oxidant a fuel-rich condition is set up. The incoming oxidant thus reacts with the ignitor mixture at a moderate temperature and without starting a steel fire.

Once ignition is assured, the valve 77 is switched from the ignitor subsystem 17 to the main generator fuel source. Thus, fuel, without pyrophoric, is introduced into the line 79 and the pilot chamber 69. The combustants in the pilot chamber are the fuel and the oxidant. The main chamber 67 may be started by causing coolant to flow through the supply line 127 and then by simultaneously opening main downhole valves 111, 113.

The flow rates of fuel and oxidant into the pilot and main chamber 67, 65 are controlled by controlling line pressures behind flow nozzle assemblies: 85, 87, 89; 101, 103, 105; and 119, 121, 123. Each flow nozzle assembly has a nozzle, a filter to prevent clogging of the nozzle and a check valve to prevent back flow. The pilot nozzles 85, 101 are calibrated so that their flows lead to highly fuel-rich combustion thereby alleviating the need for coolant injection into the pilot. The main nozzles 121 are calibrated so that their flows lead to stoichiometric combustion plus enough extra oxygen to consume unburned pilot fuel. Main coolant, usually water, is controlled and injected through injector 125 to adjust final effluent temperature in a manner known by those skilled in the art.

The downhole fuel line 78 must be traced with a heat source to prevent the vaporized pyrophoric from condensing and adhering to the tube walls. For this purpose the two-way valve 129 is switched to allow a small flow of a hot fluid (such as steam) through the downhole coolant supply line 127. The fuel and coolant lines are bundled together and insulated from the wellbore so that heat is effectively transferred to the fuel line 78. Injection of steam does not present a complication because some form of surface-generated steam drive is normally used prior to application of a downhole gas generator in an enhanced oil recovery process.

In another sequence for start-up using the application of vapor ignition shown in FIG. 1, the inert slug and its associated fuel lead time can be eliminated by pressurizing the fuel line 78 partially or completely with ignitor mixture and then topping it with generator fuel as required to obtain the starting pressure. This sequence has an advantage of providing more exact control of ignition timing.

In another embodiment of the application of the ignitor subsystem, the downhole hardware is further simplified by combining the functions of the pilot and main chamber. Referring to FIG. 1, the pilot chamber 62 and its associated flow assemblies and valves 81, 97 are eliminated. In this case the main nozzles 121 and valves 111 and 113 operate as specified in the ignition sequence for the preferred embodiment. The ignitor mixture from the ignitor subsystem 17 is introduced into the main (and only) chamber 67 of the generator 19 through the line 110. It reacts with oxidant introduced by line 112. After ignition, the valve 77 is switched to generator fuel only and combustion in the generator continues with the fuel and oxidant. The fuel nozzle is calibrated for stoichiometric combustion when flowing ignitor mixture due to the high concentration of generator fuel in this mixture. Since the normal generator flows are very high, the ignition sequence is performed with low ignitor and oxidant pressures, and once ignition is achieved the pressures are slowly increased to approach the desired heat generation. This embodiment can be used to ignite a generator wherein the function of the pilot as a retention site is replaced by some internal combustor means. An example of said means is the ignition zone and stirred vortex flow created by a convergent-divergent nozzle in the apparatus described by Burrill, et al., U.S. Pat. No. 4,456,068.

In FIG. 3 there is illustrated a schematic diagram of another embodiment of application of the ignitor subsystem 141 wherein the ignitor subsystem 141 is located downhole and the ignitor mixture is produced near the downhole generator 19. The ignitor subsystem 141 and associated nozzles 85 and 101 and valves 81 and 97 operate as described in the preferred embodiment. The start-up sequence is the same as in the preferred embodiment except that the fuel valve 81 and the oxidant valve 97 are opened simultaneously, thus allowing both to be controlled jointly by a single set of downhole control lines 142. A small line 143, preferably ⅛ inch outer diameter, is employed to supply liquid pyrophoric from the surface. Once the pyrophoric stored in the vaporizer 145 is exhausted, the main generator fuel flows through the vaporizer and continues to support pilot combustion. Heat is supplied to the vaporizer by means of a coil of tubing wound around it though which flows hot water or steam from the surface supply. A flow splitter 147 is used to supply this small flow from the larger coolant supply line 127 in a manner known by those skilled in the art. This embodiment has an advantage in providing close control of ignition sequencing while only requiring a small amount of pyrophoric, but it also has a drawback by requiring an additional downhole line to supply the pyrophoric component. In field use this system would be more dangerous because this line would have to remain sealed at all times.

Figure 4:
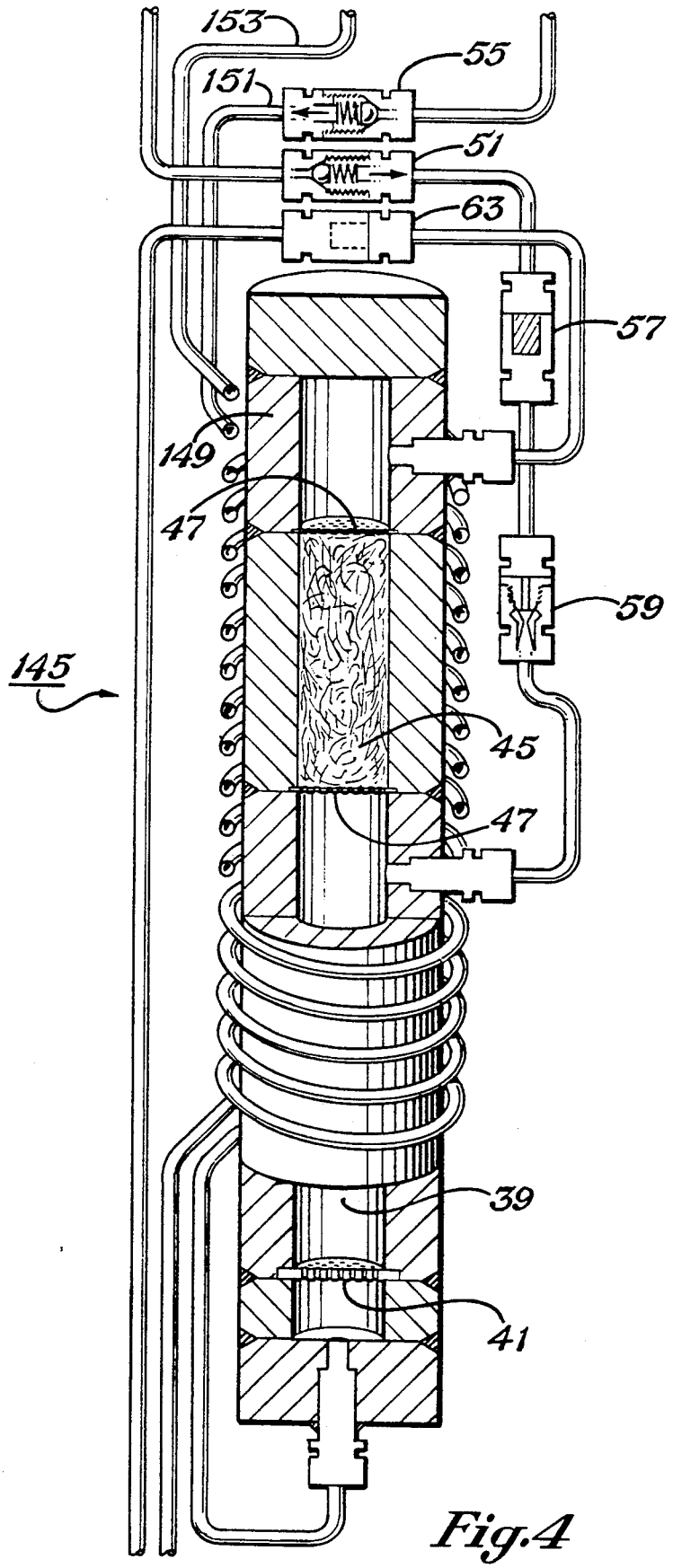
FIG. 4 is a partial longitudinal cross-sectional view of a downhole vaporizer ignitor subsystem.

In FIG. 4 there is illustrated an apparatus 145 for the downhole implementation of the ignitor subsystem 141 as previously described. The vaporizer cylinder 149 consists of a Schedule 80 stainless steel 316L pipe with nominal dimensions of 1.315 inches O. D. and 18 inches long. Around the cylinder are concurrently wound a fuel preheat line 151 and a heater water line 153. The entire subsystem is enclosed in an insulating material as appropriate for downhole use. The in-line check valves 51 and 55 have a 10 psi cracking pressure. The ignitor output filter 63 consists of a 40 micron mesh screen. The liquid inlet filter 57 has a sintered stainless steel element with a 7 micron pore diameter. The nozzle 59 is a square-edged or venturi orifice of the type which can be inserted into a tube fitting such as is manufactured by Fox Valve Development Corporation of East Hanover, N.J. The nozzle throat diameter is chosen to give a nominal flow of 5 cubic inches of the pyrophoric in one minute with a 100 psi differential. The liquid storage zone 39 is sufficient to hold 5 cubic inches. The sparger plate consists of a plate having 31 holes, each 0.031 inches in diameter. The liquid trap screen 45 consists of about 10 grams of fine stainless steel wool packed into a 3.5 inch section of the cylinder. Two coarse wire mesh screens 47 are attached to the cylinder to contain the trap screen.

Figure 5:
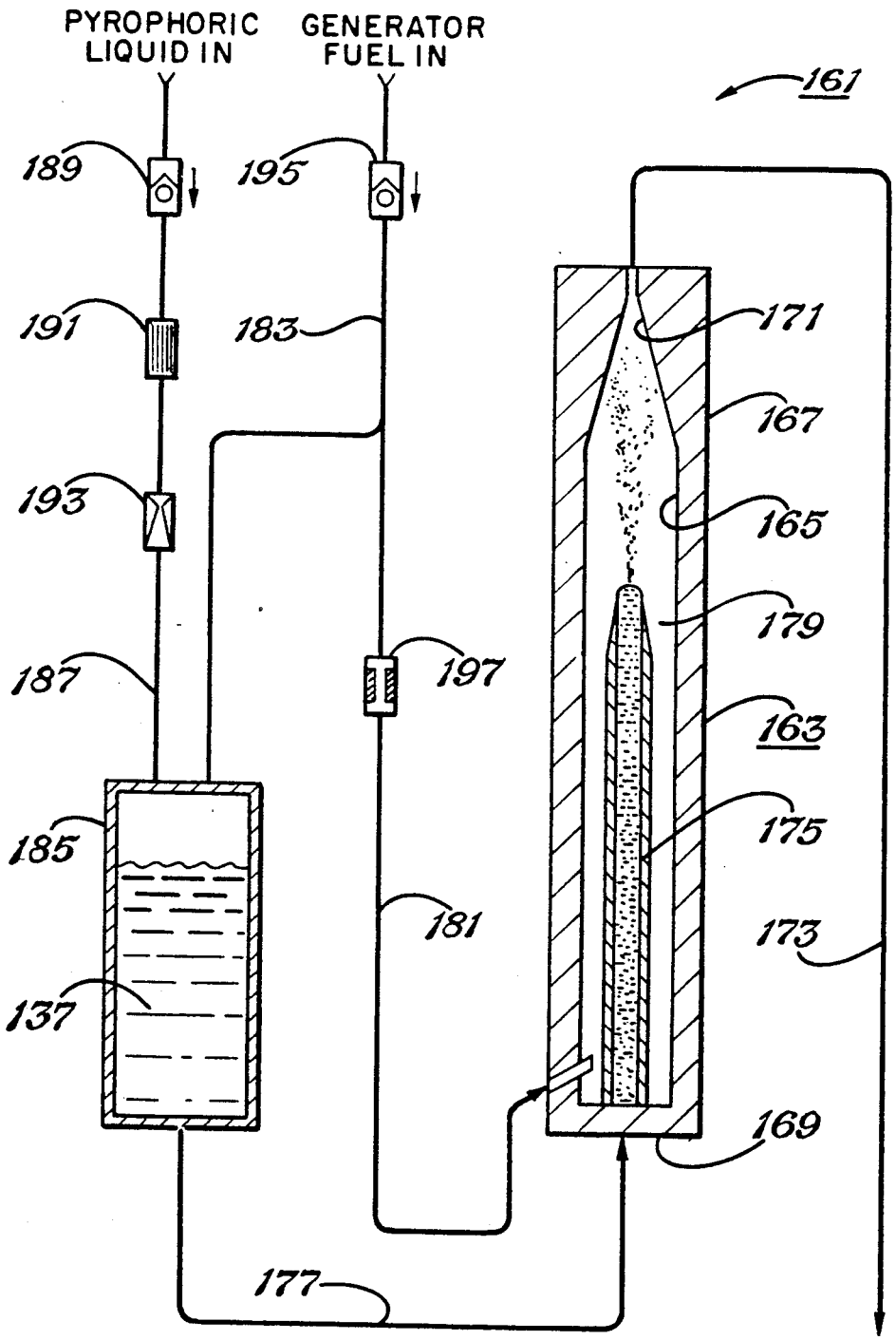
FIG. 5 is a schematic diagram of an atomizing ignitor subsystem, in accordance with still another embodiment.

Referring now to FIG. 5, there is illustrated a schematic diagram of another embodiment of an ignitor subsystem 161 of the present invention. The ignitor subsystem 161 atomizes the liquid pyrophoric into the gaseous fuel. The ignitor subsystem 101 includes an atomization assembly 163. The atomization assembly 163 has an elongated cylindrical chamber 165 that extends between the top and bottom ends 167, 169. The upper end 171 in the chamber tapers in a frustoconical fashion to a small diameter. The ignitor outlet line 173 exits the chamber 165 through the top end 167 of the atomization assembly. A cylindrical pyrophoric inlet tube 175 is located inside of the chamber 165. The tube 175 extends from the bottom end 179 of the atomization assembly, where it communicates with a pyrophoric inlet line 177, towards the top end. The tube 175 is located in the center of the chamber 167 and has an orifice 179 on its upper end. The upper end of the tube 175 is tapered. The fuel inlet line 181 couples to the atomization assembly 163 near the bottom end 169 of the atomization assembly. The fuel is injected tangentially into the chamber so as to create a swirling flow for the length of the chamber. The fuel flows from the bottom end 169 to the top end 167 of the chamber, circling the tube 175.

The fuel inlet line 181 connects to a fuel supply line 183, which in turn is connected to a fuel supply. The pyrophoric inlet line 175 is connected to the bottom of a liquid storage vessel 185. A pyrophoric supply line 187, which is connected to a pyrophoric supply, is connected to the upper end of the storage vessel 185. The pyrophoric supply line 187 has a check valve 189, a filter 191 and a nozzle 193. The fuel supply line 183 is also connected to the upper end of the storage vessel 185. The fuel supply line 183 has a check valve 195. A nozzle 197 connects the fuel supply line 183 to the fuel inlet line 181. The nozzle 197 is an orifice with little or no downstream pressure recovery, such as a square-edged orifice. The nozzle 197 is sized to give a pressure drop of between 10 and 50 psia at nominal flow conditions.

The ignitor subsystem 161 of FIG. 5 can be used in place of the ignitor subsystem 17 of FIG. 2 in any of the previously described applications simply by substituting it for the ignitor subsystem 17. Thus, the ignitor subsystem 161 can be used on the surface as shown in FIG. 1 or downhole is shown in FIG. 3. Also, the ignitor subsystem 161 ca be used with a generator having a pilot chamber or with a generator not having a pilot chamber.

The ignitor subsystem 161 utilizes atomization of the liquid pyrophoric into the gaseous fuel. As such, it does not require a heat source as for the ignitor subsystem 17, which utilizes vaporization. The ignitor subsystem 161 is therefore useful whenever the need for a heat source would present a problem.

To operate the ignitor subsystem 161 of FIG. 5, the liquid storage vessel 185 is initially filled with pyrophoric liquid 137 by way of the supply line 187. The amount is controlled by the nozzle 193 as previously described. Gaseous generator fuel is provided by the supply line 183 to pressurize the liquid pyrophoric. The fuel undergoes a pressure drop through the nozzle 197 after being injected tangentially into the chamber 165. This pressure drop is impressed upon the liquid pyrophoric 137, wherein the liquid pyrophoric is forced to flow through the orifice 179 at a controlled rate. The swirling flow of the fuel aids in the breakup and entrainment of the pyrophoric droplets. The ignitor mixture exits the chamber 165 into the outlet line 173. The flow of the ignitor mixture out through the outlet line 173 is controlled by the downstream flow control nozzle 85 (see FIG. 1).

The ignitor mixture produced by the ignitor subsystem 161 is used to ignite the generator 19, as described above.

The foregoing disclosure and the showings made in the drawings are merely illustrative of the principles of this invention and are not to be interpreted in a limiting sense.

We claim:

1. A method of providing an ignitable mixture for use in the ignition of a downhole gas generator, comprising the steps of:

a) providing a mixing chamber;

b) partially filling said chamber with liquid pyrophoric;

c) heating said chamber;

d) injecting gaseous fuel into said heated chamber at a location below said liquid pyrophoric such that said fuel bubbles through said liquid pyrophoric; wherein said gaseous fuel obtains an amount of vaporized pyrophoric therein to form said ignitable mixture.

2. The method of claim 1 further comprising the step of passing said ignitable mixture through a screen so as to trap any droplets of the liquid pyrophoric therein.

3. The method of claim 2 wherein said fuel is made to bubble through said liquid pyrophoric by passing said fuel through a sparger plate.

4. The method of claim 1 wherein said fuel is made to bubble through said liquid pyrophoric by passing said fuel through a sparger plate.

5. A method of igniting a downhole gas generator, comprising the steps of:

a) providing a mixing chamber;

b) partially filling said chamber with liquid pyrophoric;

c) heating said chamber;

d) injecting gaseous fuel into said heated chamber at a location below said liquid pyrophoric such that said fuel bubbles through said liquid pyrophoric, wherein said gaseous fuel obtains an amount of vaporized pyrophoric therein to form said ignitable mixture;

e) injecting said ignitable mixture into said gas generator along with an oxidant so as to produce combustion.

6. The method of claim 5 wherein said ignitable mixture and said oxidant are injected into a pilot chamber of said gas generator, said pilot chamber serving as a flame holder for said generator.

7. The method of claim 5 further comprising the step of changing the composition of said ignitable mixture after ignition of said gas generator is assured by eliminating said pyrophoric and injecting said fuel into said generator to react with said oxidant.

8. An apparatus for providing an ignitable mixture for use in the ignition of a downhole gas generator, comprising:

a) a mixing chamber having top and bottom walls and a side wall extending between said top and bottom walls;

b) a fuel inlet line communicating with said chamber near said bottom wall;

c) a pyrophoric inlet line communicating with said chamber intermediate said top and bottom walls, sad pyrophoric inlet line having metering means for controlling the flow of said liquid pyrophoric therethrough;

d) an outlet line communicating with said chamber near said top wall, said outlet line being adapted to be connected to an ignition location of said downhole generator;

e) bubble means for causing gaseous fuel entering said chamber through said fuel inlet line to bubble through a reservoir of said liquid pyrophoric in said chamber, said bubble means being located inside said chamber between said pyrophoric inlet line and said fuel inlet line;

f) heating means for heating said chamber to a temperature suitable for said gaseous fuel to obtain a vapor content of said liquid pyrophoric as said fuel bubbles through said pyrophoric, said heating means being located adjacent to said chamber.

9. The apparatus of claim 8 wherein said bubble means comprises a sparger plate.

10. The apparatus of claim 8 further comprising screen means for trapping liquid droplets of pyrophoric after said fuel has bubbled through said pyrophoric, said screen means being located inside said chamber between said outlet line and said pyrophoric inlet line.

11. A downhole gas generator system for use in enhanced oil recovery, comprising:

a) a generator subsystem located downhole in a well borehole, said generator subsystem capable of producing gas for use in enhanced oil recovery, said generator subsystem comprising an oxidant inlet and a generator fuel inlet;

b) an ignitor subsystem for producing an ignitable mixture, said ignitable mixture for use in igniting said generator subsystem downhole, said ignitor subsystem comprising:

i) a mixing chamber having top and bottom walls and a side wall extending between said top and bottom walls;

ii) a fuel inlet line communicating with said chamber near said bottom wall;

iii) a pyrophoric inlet line communicating with said chamber intermediate said top and bottom walls, said pyrophoric inlet line having metering means for controlling the flow of said liquid pyrophoric therethrough;

iv) an outlet line communicating with said chamber near said top wall, said outlet line being adapted to be connected to an ignition location of said downhole generator;

v) bubble means for causing gaseous fuel entering said chamber through said fuel inlet line to bubble through a reservoir of said liquid pyrophoric in said chamber, said bubble means being located inside said chamber between said pyrophoric inlet line and said fuel inlet line;

vi) heating means for heating said chamber to a temperature suitable for said gaseous fuel to obtain a vapor content of said liquid pyrophoric as said fuel bubbles through said pyrophoric, said heating means being located adjacent to said chamber;

c) said outlet line communicating with said generator fuel inlet by way of metering means for metering the amount of ignitable mixture into said generator subsystem.

12. The generator system of claim 11 wherein said ignitor subsystem is located on the surface near said borehole, said outlet line extending down said borehole to said generator subsystem.

13. The generator subsystem of claim 11 wherein said ignitor subsystem is located downhole near said generator subsystem, said pyrophoric inlet line and said fuel inlet line extending down said borehole.

14. A method of providing an ignitable mixture for use in the ignition of a downhole gas generator, comprising the steps of:

a) providing a mixing chamber;
b) providing a supply of liquid pyrophoric in said chamber;
c) injecting a gaseous fuel into said chamber in a turbulent manner, said fuel being subjected to a pressure drop before being injected into said chamber;
d) impressing said pressure drop across said pyrophoric supply such that said pyrophoric is forced to flow into said chamber;
e) mixing said turbulent gaseous fuel with said pyrophoric so as to cause said pyrophoric to break up into droplets and become entrained into said gaseous fuel, so as to form said ignitable mixture.

15. The method of claim 14 wherein said chamber is cylindrical and said gaseous fuel is injected into said chamber in a tangential direction.

16. A method of igniting a downhole gas generator comprising the steps of:
a) providing a mixing chamber;
b) providing a supply of liquid pyrophoric in said chamber;
c) injecting a gaseous fuel into said chamber in a turbulent manner, said fuel being subjected to a pressure drop before being injected into said chamber;
d) impressing said pressure drop across said pyrophoric supply such that said pyrophoric is forced to flow into said chamber;
e) mixing said turbulent gaseous fuel with said pyrophoric so as to cause said pyrophoric to break up into droplets and become entrained into said gaseous fuel, so as to form said ignitable mixture;
f) injecting said ignitable mixture into said gas generator along with an oxidant so as to produce combustion.

17. An apparatus for producing an ignitable mixture for use in the ignition of a downhole gas generator, comprising:
a) a mixing chamber having top and bottom walls and a side wall extending between said top and bottom walls, said chamber being cylindrical in extending between said top and bottom walls;
b) a fuel inlet line communicating with said chamber near said bottom wall, said fuel inlet line configured to inject gaseous fuel into said chamber in a turbulent manner;
c) an outlet line communicating with said chamber near said top wall, said outlet line being adapted to be connected to said downhole generator;
d) a pyrophoric inlet line communicating with said chamber through an orifice such that liquid pyrophoric enters said chamber through said orifice;
e) storage means for storing a supply of liquid pyrophoric, said storage means having top and bottom ends;
f) said pyrophoric inlet line being connected to said storage means near said storage means bottom end;
g) a pyrophoric supply line being connected with said storage means near said storage means top end;
h) said fuel inlet line being connected to a supply of fuel, said fuel inlet line having pressure drop means located therein, said pressure drop means providing a drop in pressure of said fuel being injected into said chamber;
i) said fuel supply being connected to said top end of said storage means, so as to impress said fuel pressure drop onto said liquid pyrophoric and draw said pyrophoric into said chamber through said orifice.

18. The apparatus of claim 17, further comprising metering means for metering an amount of pyrophoric added to said storage means, said metering means being located in said pyrophoric supply line.

19. The apparatus of claim 17, wherein said fuel inlet line communicates with said chamber so as to inject said fuel in a tangential manner into said chamber.

20. The apparatus of claim 17 wherein said pressure drop means comprises a square edge orifice in said fuel inlet line.

21. A downhole gas generator system for use in enhanced oil recovery, comprising:
a) a generator subsystem adapted to be located downhole in a well borehole, said generator subsystem capable of producing gas for use in enhanced oil recovery, said generator subsystem comprising an oxidant inlet and a generator fuel inlet;
b) an ignitor subsystem for producing an ignitable mixture, said ignitable mixture for use in igniting said generator subsystem downhole, said ignitor subsystem comprising:
i) a mixing chamber having top and bottom walls and a side wall extending between said top and bottom walls, said chamber being cylindrical in extending between said top and bottom walls;
ii) a fuel inlet line communicating with said chamber near said bottom wall, said fuel inlet line configured to inject gaseous fuel into said chamber in a turbulent manner;
iii) an outlet line communicating with said chamber near said top wall, said outlet line being adapted to be connected to said downhole generator;
iv) a pyrophoric inlet line communicating with said chamber through an orifice such that liquid pyrophoric enters said chamber through said orifice;
v) storage means for storing a supply of liquid pyrophoric, said storage means having top and bottom ends;
vi) said pyrophoric inlet line being connected to said storage means near said storage means bottom end;
vii) a pyrophoric supply line being connected with said storage means near said storage means top end;
viii) said fuel inlet line being connected to a supply of fuel, said fuel inlet line having pressure drop means located therein, said pressure drop means providing a drop in pressure of said fuel being injected into said chamber;
ix) said fuel supply being connected to said top end of said storage means, so as to impress said fuel pressure drop onto said liquid pyrophoric and draw said pyrophoric into said chamber through said orifice;
c) said outlet line communicating with said generator fuel inlet by way of metering means for metering the amount of ignitable mixture into said generator subsystem.

* * * * *